US011925302B2

(12) United States Patent
Wörz

(10) Patent No.: US 11,925,302 B2
(45) Date of Patent: Mar. 12, 2024

(54) AIR OUTLET SYSTEM FOR A PORTABLE DRY VACUUM CLEANER

(71) Applicant: Hilti Aktiengesellschaft, Schaan (LI)

(72) Inventor: Sonya Wörz, Penzing (DE)

(73) Assignee: Hilti Aktiengesellschaft, Schaan (LI)

( * ) Notice: Subject to any disclaimer, the term of this patent is extended or adjusted under 35 U.S.C. 154(b) by 748 days.

(21) Appl. No.: 17/048,173

(22) PCT Filed: Apr. 24, 2019

(86) PCT No.: PCT/EP2019/060509
§ 371 (c)(1),
(2) Date: Oct. 16, 2020

(87) PCT Pub. No.: WO2019/214945
PCT Pub. Date: Nov. 14, 2019

(65) Prior Publication Data

US 2021/0161337 A1 Jun. 3, 2021

(30) Foreign Application Priority Data

May 9, 2018 (EP) ..... 18171424

(51) Int. Cl.
*A47L 5/14* (2006.01)
*A47L 5/24* (2006.01)
(Continued)

(52) U.S. Cl.
CPC ..... *A47L 5/14* (2013.01); *A47L 5/24* (2013.01); *A47L 7/04* (2013.01); *A47L 9/22* (2013.01); *A47L 9/248* (2013.01)

(58) Field of Classification Search
CPC ..... A47L 5/24; A47L 5/28; A47L 9/22; A47L 5/14
See application file for complete search history.

(56) References Cited

U.S. PATENT DOCUMENTS 4,225,999 A 10/1980 Martinex et al.
5,606,769 A * 3/1997 Tomasiak ..... A47L 9/22 15/327.2

(Continued)

FOREIGN PATENT DOCUMENTS

CN 1618391 A 5/2005
CN 1644150 A 7/2005

(Continued)

OTHER PUBLICATIONS

International Search Report of PCT/EP2019/060509, dated Jul. 15, 2019.

*Primary Examiner* — Michael D Jennings
(74) *Attorney, Agent, or Firm* — Davidson, Davidson & Kappel, LLC

(57) ABSTRACT

An air outlet system for a portable dry vacuum cleaner, via which intake air sucked in by the dry vacuum cleaner can be expelled into the surroundings as exhaust air, wherein the air outlet system has an accommodation bay, which is to be arranged in a housing of the dry vacuum cleaner and in which optionally an air filter cartridge or an outlet adapter may be accommodated, wherein the outlet adapter has an outlet fitting for the connection of a blower hose and the air filter cartridge is free from an outlet fitting of this kind.

16 Claims, 4 Drawing Sheets

(51) Int. Cl.

| | |
|---|---|
| ***A47L 7/04*** | (2006.01) |
| *A47L 9/22* | (2006.01) |
| *A47L 9/24* | (2006.01) |

(56) References Cited

U.S. PATENT DOCUMENTS

| | | | | |
|---|---|---|---|---|
| 6,125,501 | A * | 10/2000 | Yip | A47L 5/24 15/352 |
| 7,418,763 | B2 | 9/2008 | Shaver et al. | |
| 7,712,182 | B2 | 5/2010 | Zeiler et al. | |
| 2003/0145419 | A1* | 8/2003 | Park | A47L 9/0081 15/352 |
| 2004/0216264 | A1* | 11/2004 | Shaver | A47L 5/14 15/344 |
| 2005/0183406 | A1* | 8/2005 | Coburn | A47L 9/125 55/502 |
| 2007/0017063 | A1* | 1/2007 | Park | A47L 9/325 15/351 |
| 2007/0028413 | A1* | 2/2007 | Fischer | A47L 9/32 15/334 |
| 2007/0039124 | A1* | 2/2007 | Kang | A47L 5/28 15/347 |
| 2017/0156559 | A1* | 6/2017 | Krebs | A47L 9/1625 |

FOREIGN PATENT DOCUMENTS

| | | | |
|---|---|---|---|
| CN | 103565350 | A | 2/2014 |
| EP | 3238589 | A1 | 11/2017 |
| JP | H01310624 | A | 12/1989 |
| JP | 2003275150 | A | 9/2003 |
| JP | 2014097117 | A | 5/2014 |

* cited by examiner

AIR OUTLET SYSTEM FOR A PORTABLE DRY VACUUM CLEANER

The present invention relates to an air outlet system for a dry vacuum cleaner. Via an air outlet system, intake air sucked in by the dry vacuum cleaner can be expelled into the surroundings as exhaust air.

BACKGROUND

Air outlet systems and dry vacuum cleaners of the type mentioned in the introduction are known in principle from the prior art.

SUMMARY OF THE INVENTION

It is an object of the present invention to provide an air outlet system which favors a compact and flexible construction of a dry vacuum cleaner.

The present invention provides that the air outlet system has an accommodation bay, which is to be arranged in a housing of the dry vacuum cleaner and in which optionally an air filter cartridge or an outlet adapter may be accommodated, wherein the outlet adapter has an outlet fitting for the connection of a blower hose and the air filter cartridge is free from an outlet fitting of this kind.

The air outlet system according to the invention creates the basis for a dry vacuum cleaner by means of which—in a suction mode—intake air can be sucked in via an inlet fitting and this intake air can be expelled into the surroundings as exhaust air. If an air filter cartridge is accommodated in the accommodation bay provided according to the invention, the exhaust air is expelled into the surroundings after being filtered by the air filter cartridge. If, on the contrary, the outlet adapter is accommodated in the accommodation bay instead of the air filter cartridge, a blower hose for a blowing mode of the dry vacuum cleaner can be connected to the outlet fitting of said adapter. Intake air flowing in via the inlet fitting accordingly flows as exhaust air into the surroundings through the outlet fitting and any blower hose connected thereto.

The air outlet system according to the invention creates the basis for a dry vacuum cleaner of particularly compact design.

A dry vacuum cleaner of this kind is equipped with an air outlet system according to the invention, wherein the accommodation bay of the air outlet system is arranged in the housing of the dry vacuum cleaner, and the dry vacuum cleaner furthermore has an inlet fitting, which is designed for the connection of a suction hose, which is arranged on the housing and via which the intake air is sucked in during operation, wherein the accommodation bay extends across a corner of the housing.

In this regard, it has been recognized that dry vacuum cleaners known from the prior art can have, at the rear housing end thereof for example, an air outlet which is suitable for the insertion of a blower hose. This enables the dry vacuum cleaner to be used as a "blower". It has been recognized as problematic that, the smaller the cross-sectional area of the outlet opening, the higher is also the outlet speed of the exhaust air and thus the greater is unwanted swirling of dust in the surroundings. It is likewise possible for air to impinge upon users or persons in the surroundings of such dry vacuum cleaners in an unpleasant way. The high outlet speed described is a problem particularly in the case of compact dry vacuum cleaners.

As a departure therefrom, the dry vacuum cleaner according to the invention has an accommodation bay which extends across a corner of the housing. By virtue of this positioning across a corner, space can be saved on the housing of the dry vacuum cleaner, or an outlet with a relatively large flow cross section can be made possible.

It has proven advantageous if the air filter cartridge and/or the outlet adapter are/is a modular part of the air outlet system.

In one particularly preferred refinement, the accommodation bay is designed as a diffuser. It is thus already possible to achieve a reduction in the outflow speed of the exhaust air.

At least one retention dome, on which the outlet adapter can be fastened, can be provided in the accommodation bay. Two retention domes can preferably be provided within a volume of the accommodation bay. Accordingly, the outlet adapter can have one or two plug-in or clamping pins, by means of which the outlet adapter can be fastened on the retention dome or retention domes. As an alternative, the outlet adapter can be secured in the accommodation bay by means of a screwed joint.

It has proven advantageous if the air filter cartridge has a frame having a plurality of filter openings. It is thereby possible to achieve linearization of the air, which would otherwise flow out turbulently from the accommodation bay designed as a diffuser.

The dry vacuum cleaner preferably has a substantially cuboidal housing. It has proven advantageous if the accommodation bay extends at least over 25% of the total height of the housing. The accommodation bay preferably occupies a cross-sectional area of approximately equal size to that of the two housing surface portions adjoining the common corner. In other words, the accommodation bay can be formed symmetrically across the corner of the dry vacuum cleaner housing of substantially cuboidal design.

It has proven advantageous if the inlet fitting of the dry vacuum cleaner and the accommodation bay are situated on opposite sides of the housing.

In one particularly preferred embodiment, the dry vacuum cleaner is of battery-operated design. As a particular preference, the dry vacuum cleaner is of exclusively battery-operated design. In another preferred configuration, the dry vacuum cleaner is of portable design with a weight of less than 10 kilograms. This preferably includes the weight of a rechargeable battery (preferably 22 V battery) provided for the operation of the dry vacuum cleaner.

Further advantages can be found in the following description of the figures. Various exemplary embodiments of the present invention are illustrated in the figures. The figures, the description and the claims contain numerous features in combination. A person skilled in the art will expediently also consider the features individually and combine them to form useful further combinations.

BRIEF DESCRIPTION OF THE DRAWINGS

In the figures, components which are the same and components of the same type are denoted by the same reference signs.

In the figures.

DETAILED DESCRIPTION

Figure 1:
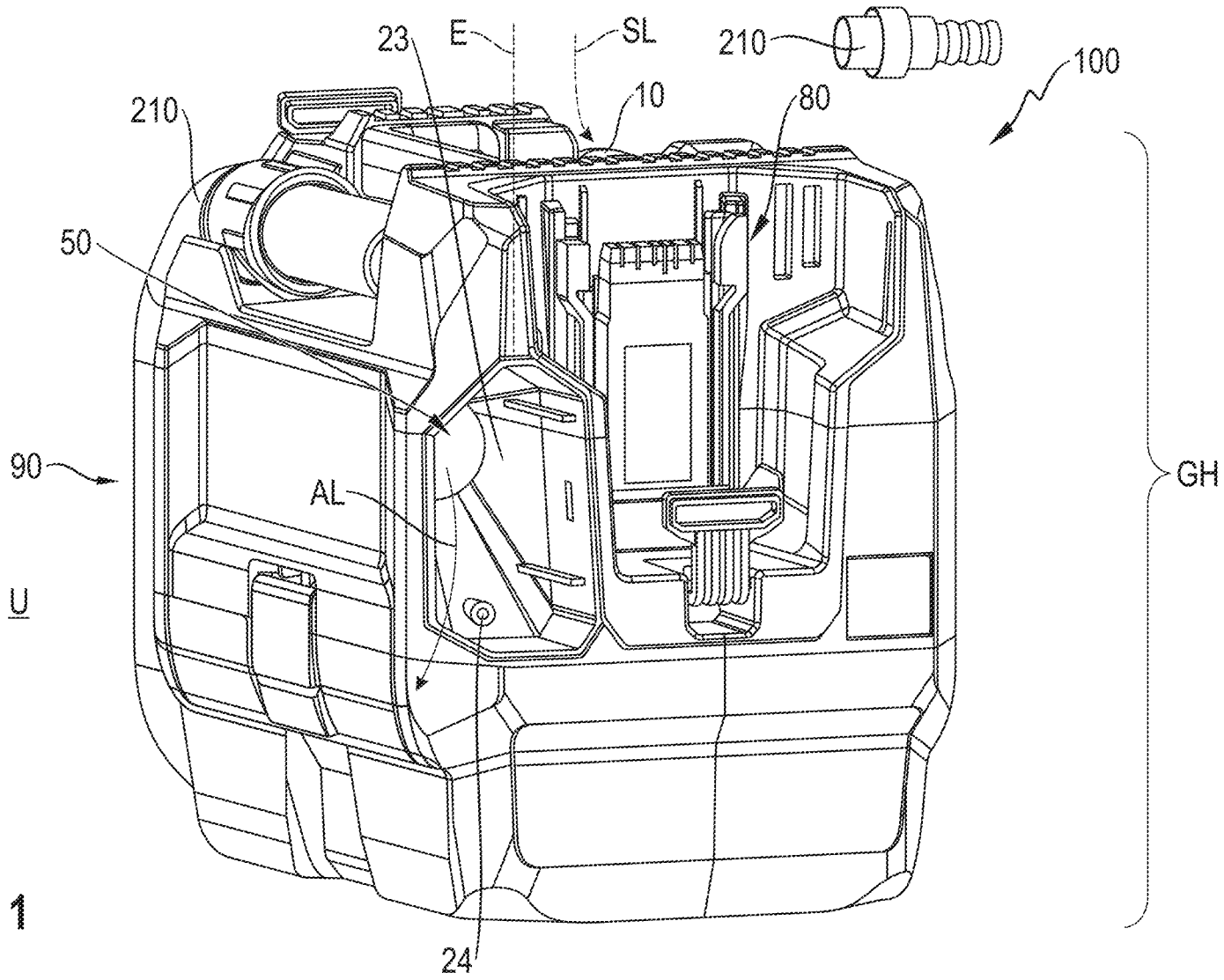
FIG. 1 shows a preferred exemplary embodiment of a portable dry vacuum cleaner having an air outlet system.

A preferred exemplary embodiment of a dry vacuum cleaner 100 according to the invention is illustrated in FIG. 1. The dry vacuum cleaner 100 in FIG. 1 is designed as a compact and portable dry vacuum cleaner which, in the present case, is exclusively battery-operated. The battery bay 80 illustrated in FIG. 1 serves to accommodate a rechargeable supply battery (not illustrated here), which preferably has a voltage of 22 V. FIG. 1 shows a rearward perspective view of the dry vacuum cleaner 100.

The dry vacuum cleaner 100 has a housing 90, which is of cuboidal design in the exemplary embodiment illustrated in the present case. Arranged on the housing 90 is an inlet fitting 10, which is used to connect a suction hose 210 (illustrated only schematically here). The inlet fitting 10 is situated on the front side of the dry vacuum cleaner 100 and, accordingly, is only partially visible in FIG. 1. Arranged on the opposite side of the housing 90 from the inlet fitting 10, i.e. in the foreground in FIG. 1, is an air blowing system 50 of the dry vacuum cleaner 100. The air outlet system 50 has an accommodation bay 23, which is extended across a corner E (vertical dashed line indicates corner E). In other words, the accommodation bay 23 extends across the corner E of the housing 90. In this arrangement, the accommodation bay 23 extends over at least 25% of the total height GH of the housing 90.

During the operation of the dry vacuum cleaner 100, air is sucked into the inlet fitting 10 or the suction hose 210 connected to the inlet fitting 10 from the surroundings U as intake air SL. This intake air SL carries dirt particles, which are separated out within the dry vacuum cleaner 100. A filter (not illustrated specifically) within the dry vacuum cleaner 100 is responsible for this. The intake air SL sucked in is then blown out into the surroundings U as exhaust air AL. This takes place through the air outlet system 50 or, to be more precise, through the accommodation bay 23 illustrated here.

As can be seen from FIG. 1, the accommodation bay 23 is designed as a diffuser, and therefore the emerging exhaust air AL already undergoes a reduction in speed.

Figure 2:
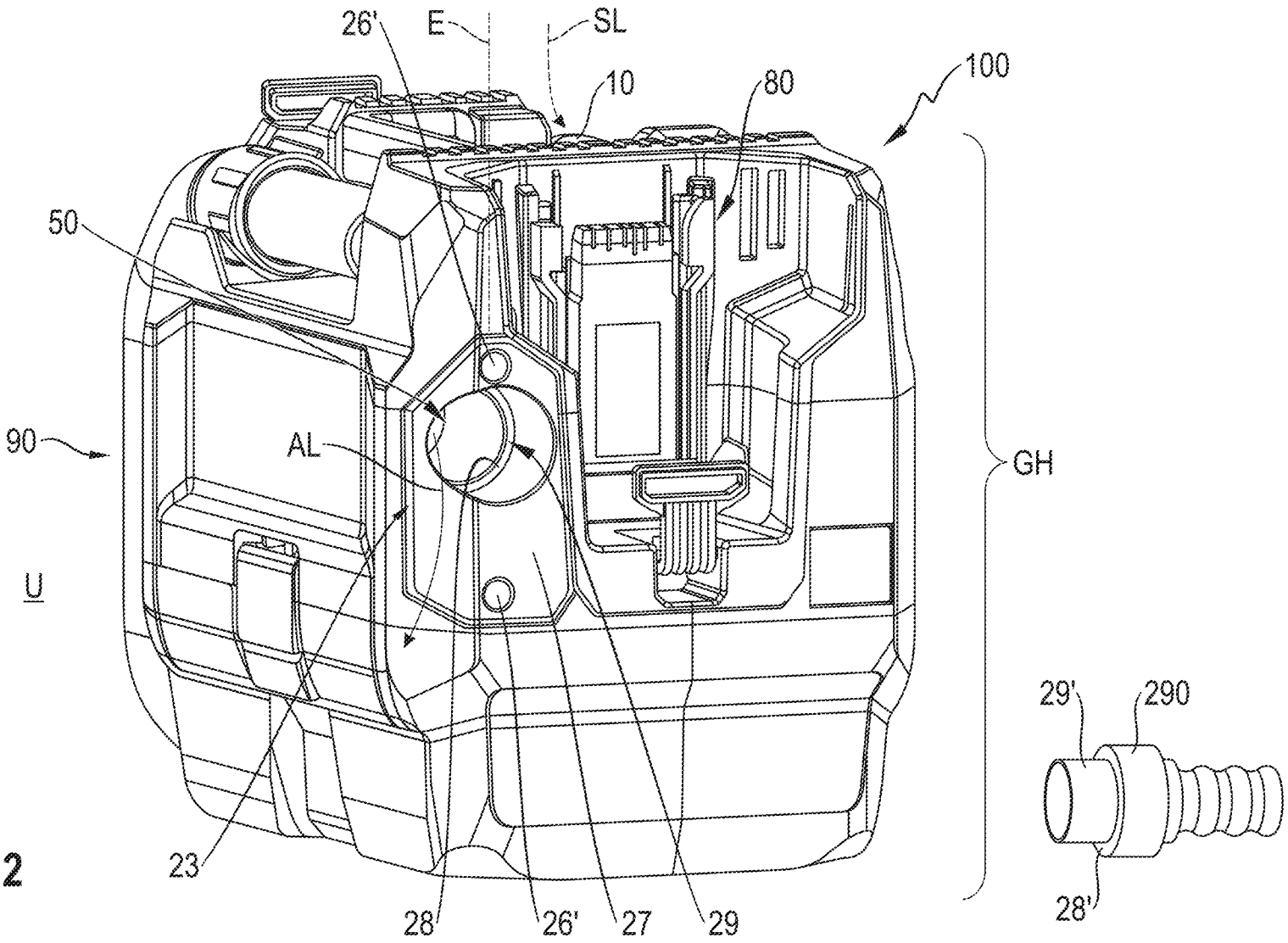
FIG. 2 shows the exemplary embodiment in FIG. 1, wherein an outlet adapter is accommodated in the accommodation bay.
Figure 3:
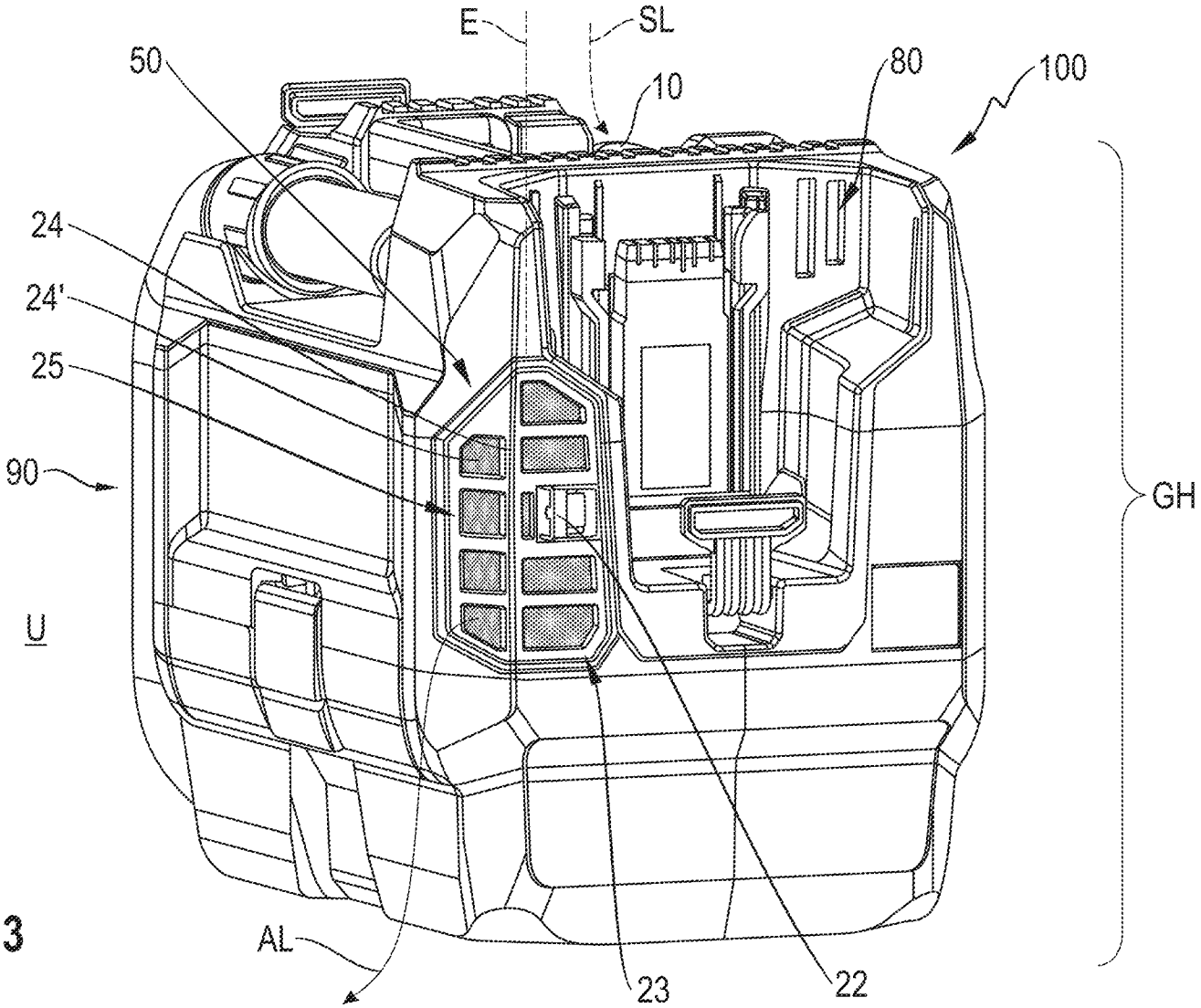
FIG. 3 shows the exemplary embodiment in FIG. 1, wherein an air filter cartridge is accommodated in the accommodation bay.
Figure 4:
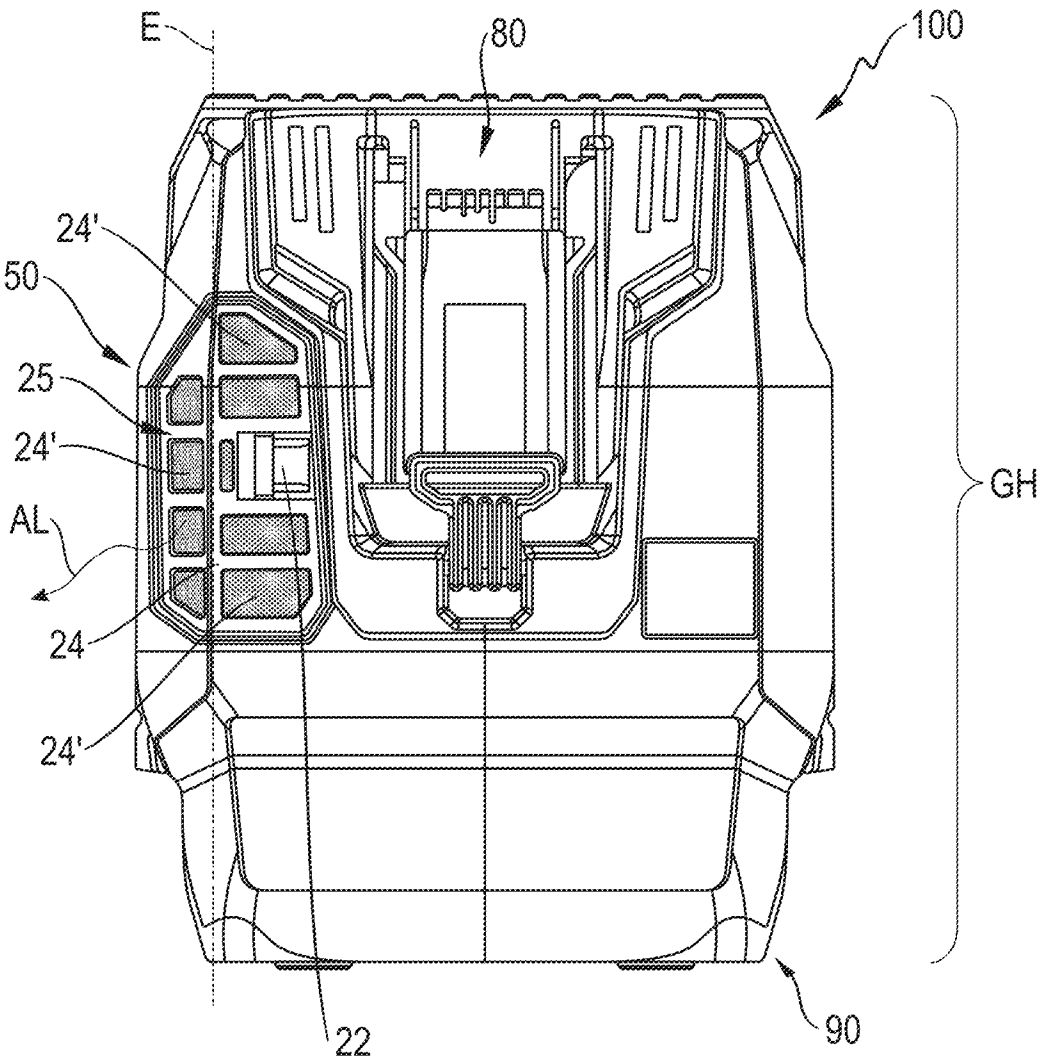
FIG. 4 shows a different view of the exemplary embodiment of FIG. 3.

The air outlet system 50 has two modular components, namely an outlet adapter 27 (cf. FIG. 2) and an air filter cartridge 25 (cf. FIGS. 3 and 4). The accommodation bay 23 without the cartridges accommodated therein is readily visible in FIG. 1. A retention dome 24 situated within a lumen of the accommodation bay 23 is used to fasten the outlet adapter 27 by means of a clamping pin, which corresponds to the retention dome 24. To be more precise, two retention domes 24, of which only the lower one is visible here, are arranged in the accommodation bay 23.

FIG. 2 then shows the dry vacuum cleaner 100, wherein an outlet adapter 27 is accommodated in the air outlet system 50. The outlet adapter 27 has an outlet fitting 29 for the connection of a blower hose 290 (illustrated schematically here). The intake air SL sucked in by the inlet fitting 10 then emerges into the surroundings U via the outlet fitting 29 or via the blower hose 290 to be connected to the outlet adapter 27.

As can be seen from FIG. 2, the outlet adapter 27 is arranged with an accurate fit in the accommodation bay 23.

The outlet adapter 27 has a cylindrical opening with an offset stop 28. One hose end 29' of the blower hose 290 can be inserted with an accurate fit into this opening, wherein the counterstop 28' makes stop contact with the stop 28 of the outlet adapter 27. The inner opening of the outlet adapter 27 is of cylindrical design corresponding to the hose end 29'. As an alternative, a tapered joint between the outlet adapter 27 and the hose end 29' can be implemented.

As is readily visible from FIG. 2, the outlet adapter 27 accommodated in the accommodation bay 23 also extends across the corner E, wherein it occupies portions of the surface of the rear side and of the side of the housing 90 of the dry vacuum cleaner 100. The outlet adapter 27 is held securely within the accommodation bay 23 by means of two clamping pins 26', which engage in the retention domes 24 shown in FIG. 1.

FIG. 3 shows the dry vacuum cleaner 100, wherein an air filter cartridge 25 is accommodated in the accommodation bay 23 (concealed here) of the air outlet system 50. In contrast to the outlet adapter 27 shown in FIG. 2, the air filter cartridge 25 in FIG. 3 is free from any outlet fitting. In other words, there is no intention to connect a blower hose or the like to the air filter cartridge 25. On the contrary, the intake air SL sucked in by the dry vacuum cleaner emerges into the surroundings U from the air filter cartridge 25 as exhaust air AL. This takes place through a number of filter openings 24', which are defined by a frame 24 of the air filter cartridge 25.

As can be seen from FIG. 3, the frame 24 together with the filter mat visible behind the filter openings 24' lies across the corner E of the housing 90. As can likewise be seen from FIG. 3, there are filter openings 24' both on the side and on the rear side of the housing 90, thereby providing a relatively large outflow cross section for exhaust air AL. Here too, it is clearly apparent that the accommodation bay 23 and the air filter cartridge 25 accommodated with an accurate fit therein extend over at least 25% of the total height GH of the housing 90. The air filter cartridge 25 together with the frame 24 is fastened to the housing 90 by means of a clip fastener 22.

Finally, FIG. 4 shows a [[ . . . ]] rear view of the dry vacuum cleaner 100. It is clearly apparent that the air filter cartridge 25, together with the frame 24 and the filter openings 24', is formed across the corner E. In other words, exhaust air AL flows rearward (out of the plane of the image in FIG. 4) and to the side (to the left in FIG. 4) out of the filter cartridge 25. Together, the filter openings 24', which are distributed over two housing walls, offer a relatively large outflow cross-section for the exhaust air AL. Thus, as desired, a flow speed of the exhaust air AL is reduced. By virtue of the fact that flow portions of the exhaust air AL flow out both from the rear side and from the side (the side is different from the rear side), unpleasant impingement of air upon users in the surroundings of the dry vacuum cleaner is significantly reduced.

As can be seen from FIG. 4, the accommodation bay 23 hugs the battery bay 80 provided on the housing 90, thereby ensuring a particularly compact construction of the dry vacuum cleaner 100.

LIST OF REFERENCE SIGNS

10 Inlet fitting
20 Air outlet
22 Clip fastener
23 Accommodation bay
24 Frame
24' Filter openings

25 Air filter cartridge
26 Retention dome
26' Clamping pins
27 Outlet adapter
28 Stop
28' Counterstop
29 Outlet fitting
29' Hose end
50 Air outlet system
80 Battery bay
90 Housing
100 Dry vacuum cleaner
210 Suction hose
290 Blower hose
AL Exhaust air
E Corner of the housing
GH Total height of the housing
SL Intake air
U Surroundings

What is claimed is:

1. An air outlet system for a portable dry vacuum cleaner, intake air sucked in by the dry vacuum cleaner being expellable into surroundings of the portable dry vacuum cleaner as exhaust air via the air outlet system, the air outlet system comprising:

two modular parts including an outlet adapter having an outlet fitting for connection of a blower hose and an air filter cartridge free from an outlet fitting for connection of the blower hose; and an accommodation bay arrangable in a housing of the dry vacuum cleaner and capable of accommodating alternately one of the two modular parts.

2. The air outlet system as recited in claim 1 wherein the accommodation bay accommodates the outlet adapter without accommodating the outlet fitting.

3. The air outlet system as recited in claim 2 wherein the outlet adapter has a cylindrical opening with an offset stop.

4. The air outlet system as recited in claim 2 wherein the outlet adapter is held securely within the accommodation bay via two clamping pins.

5. The air outlet system as recited in claim 4 further comprising at least one retention dome for fastening the outlet adapter, the at least one retention dome being provided in the accommodation bay and engaging with the two clamping pins.

6. The air outlet system as recited in claim 1 wherein the accommodation bay accommodates the air filter cartridge without accommodating the outlet adapter.

7. The air outlet system as recited in claim 1 wherein the accommodation bay forms a diffuser.

8. The air outlet system as recited in claim 1 further comprising at least one retention dome for fastening the outlet adapter, the at least one retention dome being provided in the accommodation bay.

9. The air outlet system as recited in claim 1 wherein the air filter cartridge has a frame having a plurality of filter openings.

10. A dry vacuum cleaner comprising:

the air outlet system as recited in claim 1;

a housing, the accommodation bay of the air outlet system being arranged in the housing; and an inlet fitting designed for the connection of a suction hose and arranged on the housing, the intake air being sucked in during operation via the inlet fitting, the accommodation bay extending across a corner of the housing.

11. The dry vacuum cleaner as recited in claim 10 wherein the housing is of cuboidal design.

12. The dry vacuum cleaner as recited in claim 10 wherein the accommodation bay extends at least over 25 percent of a total height of the housing.

13. The dry vacuum cleaner as recited in claim 10 wherein the inlet fitting and the accommodation bay are situated on opposite sides of the housing.

14. The dry vacuum cleaner as recited in claim 10 wherein the dry vacuum cleaner is of battery-operated design.

15. The dry vacuum cleaner as recited in claim 10 wherein the dry vacuum cleaner is of portable design with a weight of less than 10 kilograms.

16. The dry vacuum cleaner as recited in claim 15 wherein the dry vacuum cleaner is of battery-operated design.

* * * * *